United States Patent [19]

Kaltenegger

[11] 4,343,107

[45] Aug. 10, 1982

[54] CARTRIDGE MAGAZINE FOR PISTOLS

[76] Inventor: Benno Kaltenegger, Condominio Eden Roc II, Campione b. Lugano, Italy

[21] Appl. No.: 145,387

[22] Filed: Apr. 30, 1980

[30] Foreign Application Priority Data

May 7, 1979 [CH] Switzerland ..... 4250/79

[51] Int. Cl.[3] ..... F41C 25/00

[52] U.S. Cl. ..... 42/7

[58] Field of Search ..... 42/7, 50

[56] References Cited

U.S. PATENT DOCUMENTS 967,928 8/1910 Johnson ..... 42/7

3,758,978 9/1973 Theodore ..... 42/7

FOREIGN PATENT DOCUMENTS 3220 of 1907 United Kingdom ..... 42/7

*Primary Examiner*—Charles T. Jordan

*Attorney, Agent, or Firm*—Diller, Ramik & Wight

[57] ABSTRACT

This disclosure relates to a cartridge magazine for pistols which includes a generally elongated magazine sleeve adapted to receive cartridges therein, upper and lower abutment plates housing therebetween a spring, a slide plate for retaining the magazine sleeve operatively associated with a pistol handle, and a finger support at a lower end of the magazine sleeve having a forwardly directed bead-shaped extension, the improvement being forming the finger support as a generally annular configuration disposed in external surrounding relationship to the magazine sleeve with a lower edge of the magazine sleeve and a lower edge of the bead-shaped extension lying in generally contiguous planes and the side plate lying in the plane of the bead-shaped extension lower edge.

3 Claims, 2 Drawing Figures

CARTRIDGE MAGAZINE FOR PISTOLS

Figure 1:
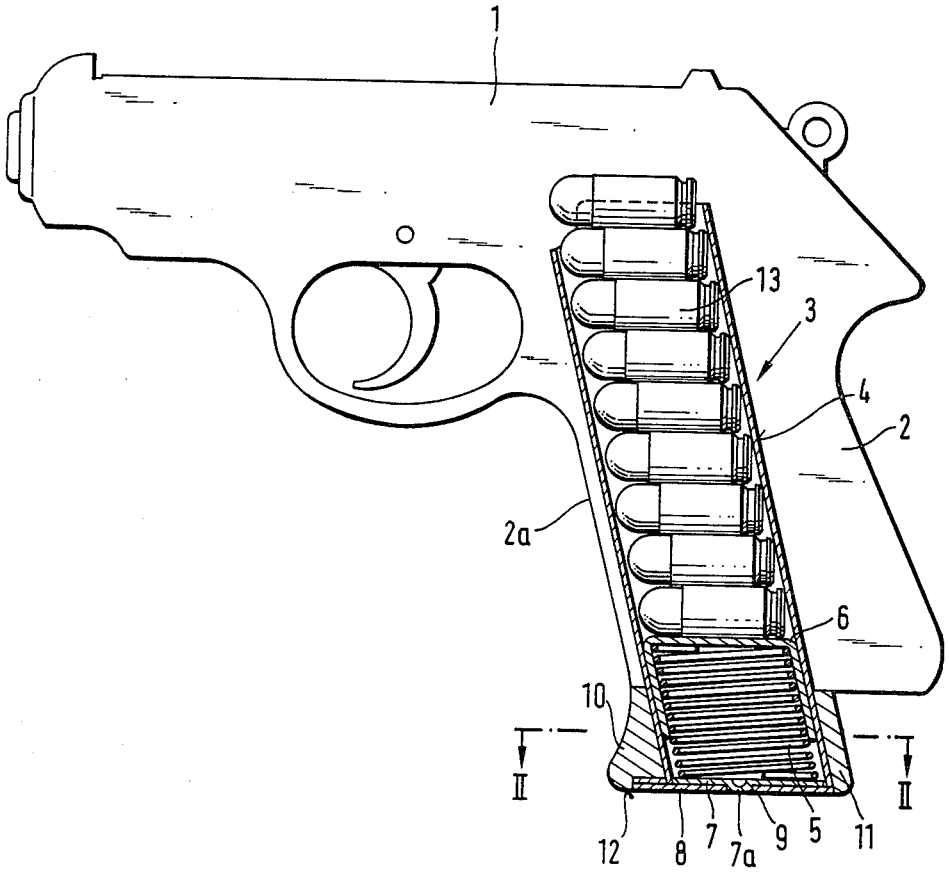

The present invention relates to a cartridge magazine for a pistol including a magazine sleeve, a spring within the magazine sleeve, and upper and lower abutment plates between which the spring is sandwiched, and a slide plate which retains the lower spring abutment plate and also retains the cartridge magazine within a bore of a pistol handle.

In a conventional pistol, the lower portion of an associated cartridge magazine sleeve is provided with a finger support, preferably constructed of plastic material, which is connected to a terminal end of the magazine sleeve and which has a bead-shaped extension projecting in a forward direction relative to the pistol with the bead-shaped extension being joined to the pistol handle without transition, i.e., in a smooth, generally uninterrupted fashion. The bead-shaped extension of the conventional pistol magazine sleeve defines a stop and a support for the little (pinky) finger, and the magazine is used to obtain a perfect handle portion. Due to the bead-shaped extension at the magazine sleeve, it is easier to grip the handle, i.e., the holding or gripping hand can not slide off unintentionally from the pistol handle. In such known conventional arrangement, the bead-shaped extension is totally solid and is, of course, attached to and forms an extension of the cartridge magazine and/or the pistol handle.

In connection with a cartridge magazine of the mentioned type, it is a primary object of this invention to impart to the bead-shaped extension or finger support at the magazine sleeve another important function, namely, the invention is characterized in that the magazine sleeve extends to the rearward projection of the lower edge of the bead-shaped finger support extension and the slide plate is provided in the plane of the lower edge of the bead-shaped extension.

In accordance with another object of this invention, it is advantageous for the extension of the bead-shaped finger support to be designed as a generally annular hollow box in external surrounding relationship to a lower end portion of the magazine sleeve.

Due to the latter design of the annular or box-shaped finger support extension, the latter not only functions as a finger support but also concomitantly assumes the duty of a cartridge magazine sleeve or, in other words, forms an extension of the magazine sleeve. As a result, the capacity for the receipt of cartridges is increased by approximately 25 to 30 percent. However, in spite of the latter-mentioned increase in capacity, the dimensions of the cartridge magazine requires the same space in length as in conventional cartridge magazines, but the bead-shaped hollow extension permits increased cartridge capacity by housing the operative elements of the cartridge magazine, namely, the abutment plates, spring, etc.

With the above and other objects in view that will hereinafter appear, the nature of the invention will be more clearly understood by reference to the following detailed description, the appended claims and the several views illustrated in the accompanying drawings.

In the drawings:

FIG. 1 is a schematic side elevational view of a pistol, and illustrates in longitudinal cross-section a cartridge magazine of the invention, including a magazine sleeve, a plurality of cartridges therein, a pair of abutment plates, a spring housed between the latter plates, a slide plate, and a generally annular sleeve having a bead-shaped finger support extension directed forwardly and in generally surrounding relationship to a lower end portion of the cartridge magazine sleeve.

Figure 2:
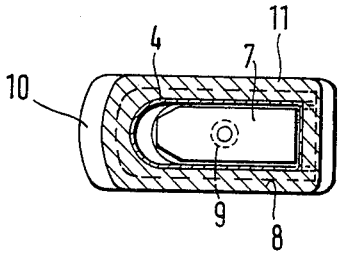

FIG. 2 is a sectional view taken generally along lines II—II of FIG. 1 with the spring omitted for clarity, and illustrates the generally annular or box-like configuration of the annular finger support and its associated projecting bead-shaped extension.

Reference is made to FIG. 1 which illustrates a pistol 1 having a handle portion 2 into which is inserted a cartridge magazine 3 which includes a magazine sleeve 4 housing therewithin a spring 5 at a generally lower end portion (unnumbered) of the magazine sleeve 4. The spring 5 is housed between an upper abutment plate 6 which is displaceable in the chamber or sleeve 4 and a lower stationary abutment plate 7. The abutment plate 7 rests upon a slide plate 8 which can be moved to the right in FIGS. 1 and 2 to release the cartridge magazine 3 from the pistol 1 in a known manner. The "safe" or "loaded" position of the slide plate 8 is achieved by the engagement of a projecting knob 7*a* of the abutment plate 7 with a recess 9 in the slide plate 8.

The handle portion 2 of the pistol 1 is provided with a bead-shaped extension 10 extending in a forward direction as a finger ("little" or "pinky") support, the extension 10 being joined substantially smoothly and without a transition to a front contour 2*a* of the handle portion 2.

The finger support extension 10 is an integral portion of a generally annular finger support or closed hollow box or member 11 which is so designed that the magazine sleeve 4 extends telescopically thereinto with a lowermost edge (unnumbered) of the magazine sleeve 4 being immediately contiguous a lowermost edge 12 of the bead-shaped finger support extension 10. The slide plate 8 lies generally in the plane of the lower edge 12, while the abutment plate 7 is slightly above this plane, as is most evident from FIG. 1.

The bead-shaped finger support extension 10 is suitably as high as the extensions used heretofore in conventional pistols in the form of solid or open U-shaped parts. However, due to the closed hollow box design or annular configuration of the finger support 11 and its associated finger support extension 10, much space is obtained for the housing of the cartridges 13 because the hollow nature of the finger support 11 houses at least partly therein the abutment plate 7, the spring 5 and a downwardly directed peripheral wall (unnumbered) of the abutment plate 6. Thus, with the same cartridge caliber the space for two additional cartridges is gained by utilizing the full height of the finger support 11 as an extension of the magazine sleeve 4 so that it is possible for the cartridge magazine 3 to house a greater number of cartridges (two more) than before with the same height of the handle portion 2 together with the finger support 11 and, of course, its forward finger support extension or bead-shaped extension 10. Such an increase in capacity of the cartridge magazine 3 of the pistol 1 is of great importance in practice, particularly since the overall length of the pistol handle 2 with the finger support 11 not being greater than heretofore while accommodating at least two additional cartridges for a particular caliber and due to the hollow nature of the finger support 11.

The magazine sleeve 4 is, of course, slightly longer than in conventional cartridge magazines since it must be extended for its telescopic receipt within the finger support 11, but the total exterior length of the cartridge magazine 3 and the associated finger support 11 remains unchanged from conventional cartridge magazines. Thus, the pistol 1 can be manipulated in the same fashion as other similar pistols and, of course, can be accommodated in conventionally sized and shaped holsters or the like.

Although only a preferred embodiment of the invention has been specifically illustrated and described herein, it is to be understood that minor variations may be made in the apparatus without departing from the spirit and scope of the invention, as defined in the appended claims.

I claim:

1. In a cartridge magazine for pistols of the type including an elongated magazine sleeve adapted to receive cartridges therein, upper and lower abutment plates housing therebetween a spring, a slide plate for retaining the magazine sleeve operatively associated within a pistol handle, and a finger support at a lower end of the magazine sleeve having a forwardly directed bead-shaped extension, the improvement comprising a lower edge of the magazine sleeve and a lower edge of the bead-shaped extension lying in generally contiguous planes, and said slide plate lying in the plane of said bead-shaped extension lower edge.

2. The improvement in a cartridge magazine as defined in claim 1 wherein said finger support is of a generally annular configuration disposed in external surrounding relationship to said magazine sleeve.

3. The improvement in a cartridge magazine as defined in claim 2 including a pistol having a handle which in turn includes a lowermost forwardly directed ring finger support surface having a contour merging generally uninterruptedly and smoothly with an uppermost portion of said forwardly directed bead-shaped extension which defines a little-finger support surface.

* * * * *